United States Patent [19]

Evans

[11] 4,438,997

[45] Mar. 27, 1984

[54] PIVOTING ELECTRICAL CONTACT

[75] Inventor: William R. Evans, Clemons, N.C.

[73] Assignee: AMP Incorporated, Harrisburg, Pa.

[21] Appl. No.: 288,618

[22] Filed: Jul. 30, 1981

Related U.S. Application Data

[63] Continuation-in-part of Ser. No. 136,852, Apr. 3, 1980.

[51] Int. Cl.[3] ..... H01R 11/20

[52] U.S. Cl. ..... 339/97 R

[58] Field of Search ..... 339/97 R, 97 P, 98, 339/107, 96, 99, 95 D, 275 B, 258 P

[56] References Cited

U.S. PATENT DOCUMENTS

| | | | |
|---|---|---|---|
| 3,233,206 | 2/1966 | Fiala | 339/98 |
| 4,133,595 | 1/1979 | Pritulsky | 339/95 D |
| 4,324,450 | 4/1982 | Weisenburger et al. | 339/97 P |

*Primary Examiner*—Paul A. Bell

*Assistant Examiner*—John S. Brown

*Attorney, Agent, or Firm*—Donald M. Boles; Gerald K. Kita

[57] ABSTRACT

An electrical contact (1) includes a plate portion (10), flaps (16) are on the plate portion. A notch (12) in the plate portion straddles an insulated conductor (40), the plate portion (10) is pivoted against the conductor to penetrate sides of the notch into the conductor and establish an electrical connection, and the flaps (16) press against the conductor and establish a strain relief.

6 Claims, 11 Drawing Figures

Fig. 1
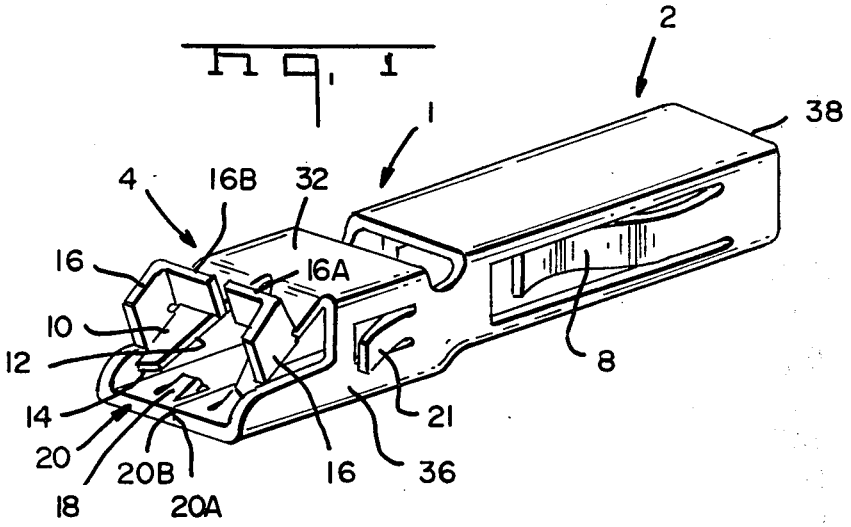
Fig. 7
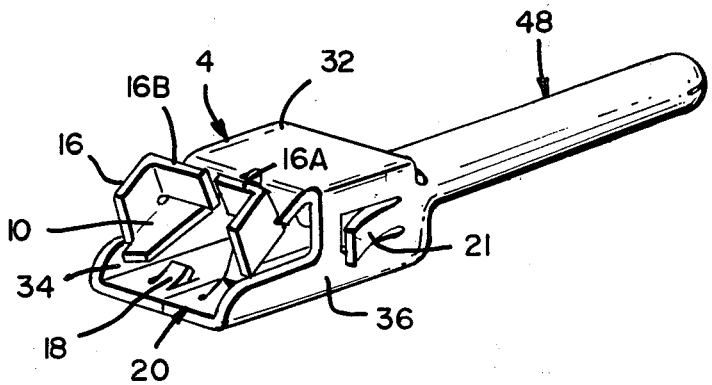
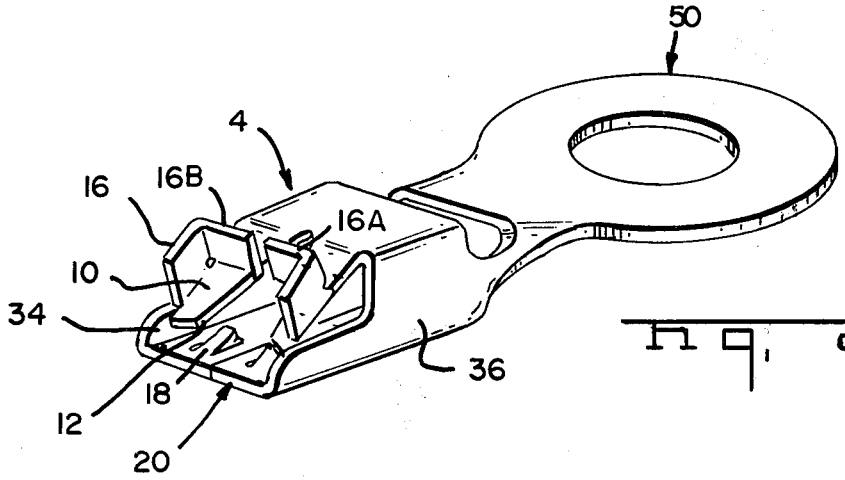
Fig. 8

PIVOTING ELECTRICAL CONTACT

RELATED APPLICATION

This application is a continuation-in-part of application Ser. No. 06/136,852, filed Apr. 3, 1980.

FIELD OF THE INVENTION

The present invention relates to an electrical contact for connections to an insulated conductor, and which penetrates the insulation on the conductor to establish an electrical connection.

BACKGROUND OF THE PRIOR ART

There is described in U.S. Pat. No. 4,114,975, an electrical contact stamped and formed from a metal blank and comprising a plate portion, a notch in the free end of the plate portion, the sides of the notch define conductor engaging jaws, and the plate portion is curled toward an insulated conductor supported on the contact, so that the jaws are forced to straddle the conductor and penetrate through the insulation of the conductor and penetrate partially into the conductor to establish an electrical connection. The contact is used in conjunction with an insulation housing. The housing confines the plate portion in a curled position.

SUMMARY OF THE INVENTION

The present invention resides in an electrical contact stamped and formed from a metal blank, and comprises a plate portion, a notch communicating with a free end of the plate portion, opposite sides of the notch define insulation penetrating and conductor gripping jaws constructed for straddling and gripping a conductor to establish an electrical connection, and the contact locks the jaws while the jaws grip the conductor, and the contact provides a strain relief for the conductor, without assistance by a housing.

A contact according to the invention, and as described in the previous paragraphs, is characterized in that; a conductor receiving receptacle is adjacent the plate portion, the receptacle has an open end and an internal cavity for receipt of the conductor within the receptacle, the plate portion is pivotally connected to the remainder of the terminal and is pivotal toward the cavity of the receptacle, and into connection with the conductor and tabs on the receptacle lock the plate portion transversely of the cavity and in electrical connection with the conductor.

An object of the present invention is to provide an electrical contact of one piece construction adapted for connection to an insulated conductor and constructed for locking when connected to the conductor, and constructed to provide a strain relief for the conductor.

Another object of the present invention is to provide a stamped and formed contact constructed to establish an electrical connection with an insulated conductor by penetrating the insulation on the conductor, and to provide a strain relief for the conductor, without a need for confinement by a housing.

Other objects and advantages of the invention are apparent from the following detailed description taken in conjunction, by way of example, with the drawings.

FIG. 1 is a perspective view of a contact according to the present invention in the form of an electrical receptacle.

FIGS. 7, 8, 9 and 10 are perspective views of alternative forms of the contact according to the present invention.

Figure 2:
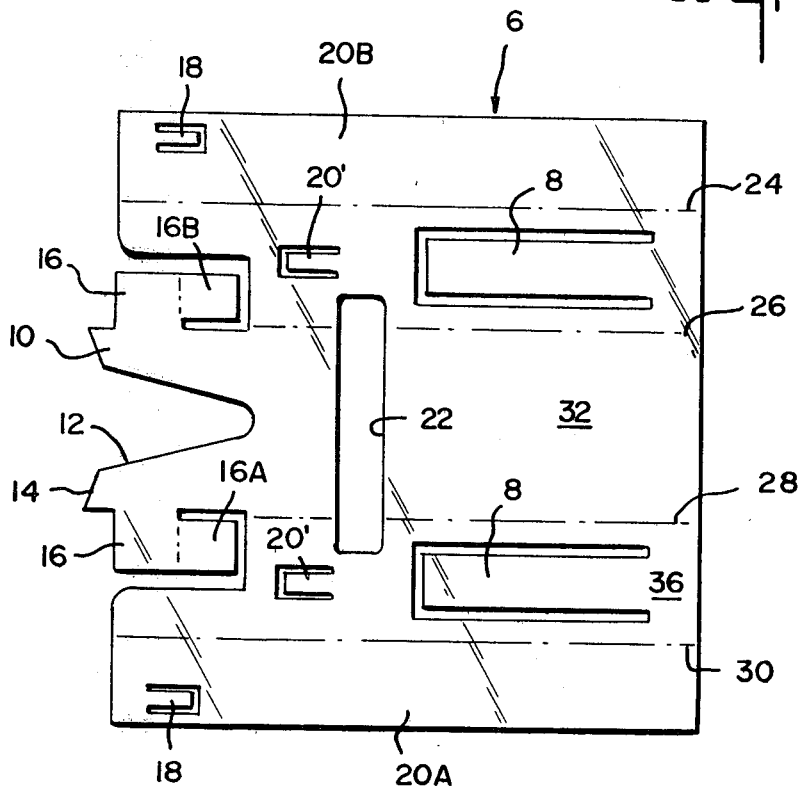
FIG. 2 is a plan view of a stamped metal blank prior to forming the contact shown in FIG. 1.

By way of example in references to the drawings, FIG. 1 shows an electrical contact (1) having an electrical receptacle portion (2) and a conductor connecting portion (4). The contact (1) is formed from a metal blank (6) shown in FIG. 2. The blank (6), while flat, is fabricated by a stamping operation to comprise a pair of elongated resilient spring fingers (8) (8), each separated on three sides from the remainder of the blank (6) and remainin connected to the blank at one end. The blank (6) also comprises plate portion (10) having a tapered notch (12) communicating with a free end (14) of the plate portion (10). The sides of the notch (12) define conductor penetrating jaws. Flaps (16) (16) are integral with respective jaws. Tabs (18) are fabricated during the stamping operation adjacent side margins (20A) (20B) of the blank (6). Optional lances (21) also are fabricated by stamping. A window (22) is stamped in the blank (6) to relieve internal stresses.

During a series of forming operations, the component parts are formed out of the plane of the blank to their configurations shown in FIG. 1. The plate portion (10) is pivotally joined by a fold hinge (12A) to the remainder of the contact (1). The flaps (16) (16) are bent out of the plane of the plate portion and are formed to L-shapes with portions (16A) (16B) projecting toward each other. The blank (6) is folded, along fold lines (24) (26) (28) (30), to form the box-shaped receptacle portion (2). Thereby a sidewall (32) of the receptacle is formed between the folds (26) (28), a sidewall (34) is formed between the folds (28) (30). Yet another sidewall (20) is formed by a composite of the side margins (20A) (20B) placed alongside each other.

The receptacle portion (2) is a type known in U.S. Pat. No. 3,269,805, and has an open end (38) into which is inserted a pin electrical terminal (not shown) for engagement by and between the fingers (8), to establish an electrical connection.

Figure 4A:
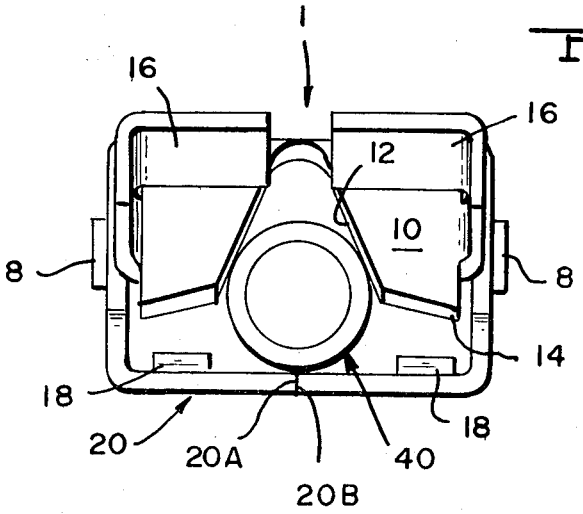
FIG. 4A is an end elevation taken along the line 4A—4A of FIG. 4.
Figure 3:
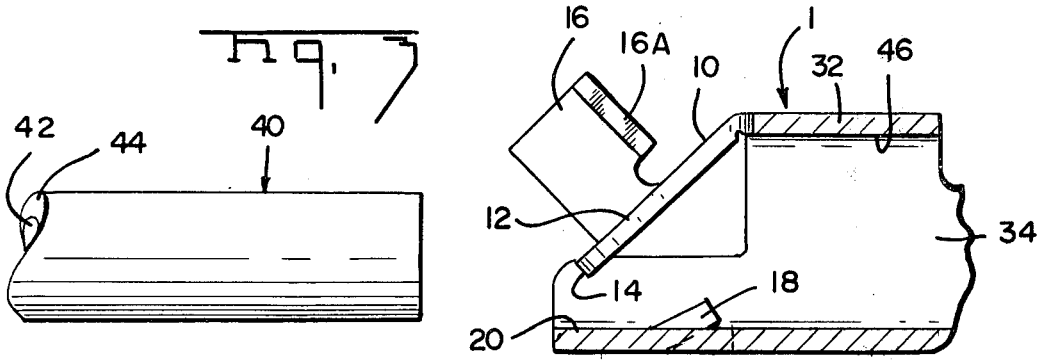
FIGS. 3, 4 and 5 are fragmentary elevations in section, each showing a portion of the contact in various positions during connection to an insulated conductor.
Figure 4:
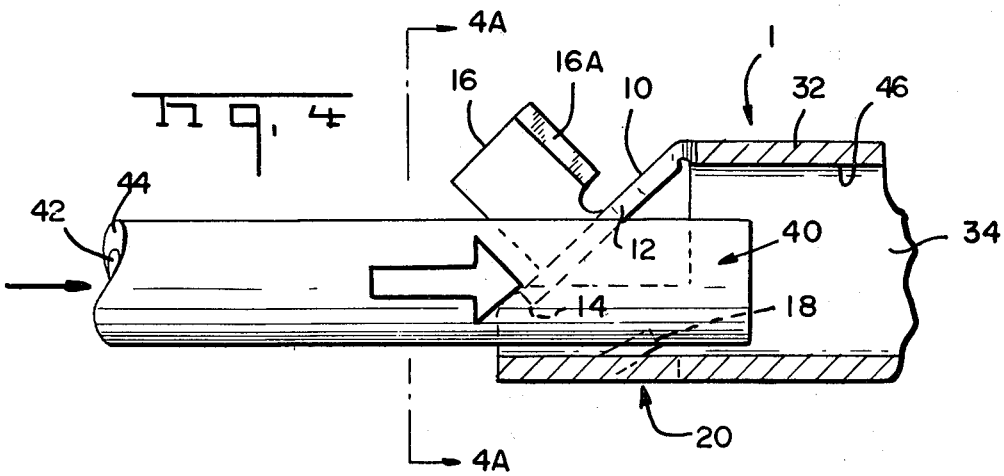
Figure 5:
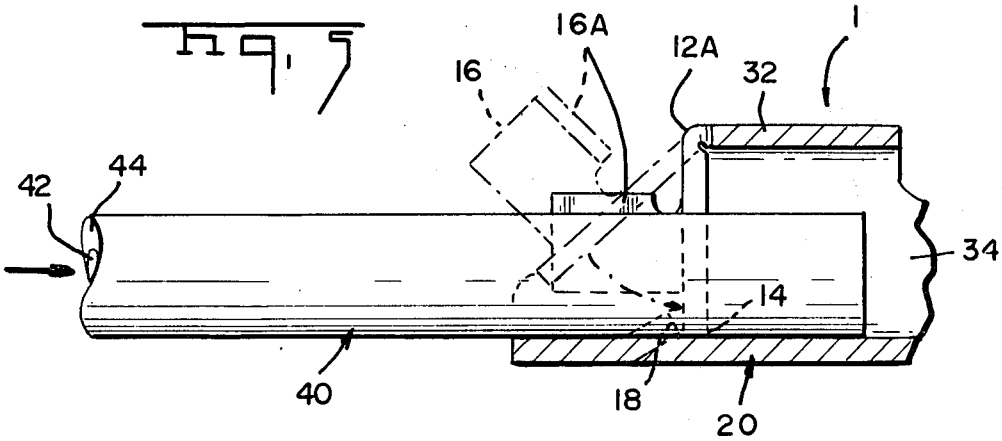
Figure 6:
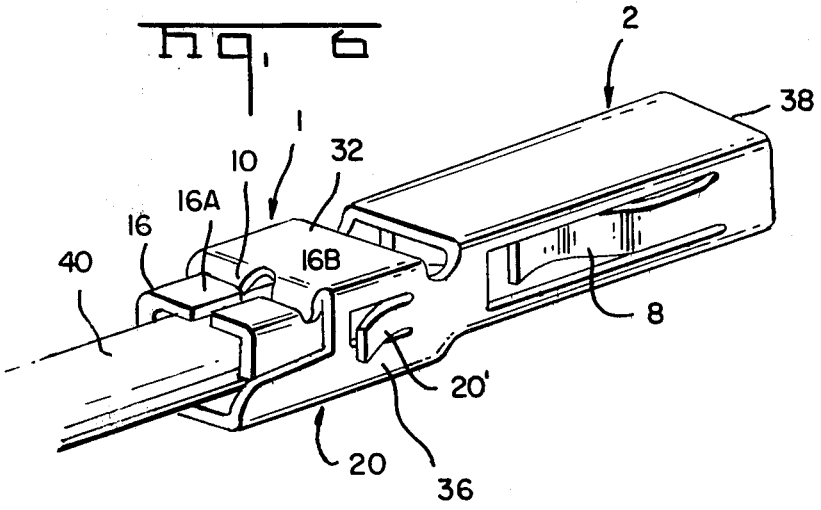
FIG. 6 is a perspective view of the contact shown in FIG. 1 connected to an insulated conductor and providing a strain relief for the conductor.

As described with reference to FIGS. 3, 4, 5 and 6, the contact (1) is adapted for connection to an insulated conductor (40) which comprises a wire (42) covered with a sheath of insulation (44). As shown in FIG. 4A, the conductor (40) is inserted axially of its length into an open end of the contact (1) defined between the sidewall (20) and a larger width portion of the tapered notch (12). As shown by the arrow of FIG. 4, the conductor is inserted also into an internal cavity (46) of the contact (1) defined and encircled by the receptacle sidewalls (20) (32) (34) (36). Thereafter, as shown in FIG. 5, the plate portion (10) is pivoted about the fold hinge (12A) toward the sidewall (20) and against the conductor (40). As the plate portion is pivoted, the free end (14) engages and deflects the tabs (18) resiliently to permit passage of the plate portion over the tabs. Once the plate portion is pivoted past the tabs, the tabs resiliently spring outwardly of the sidewall (20) and lock against the free end (14) and retain the plate portion (10) against the conductor (40) and transversely of the cavity (46). The jaws of the slot (12) are forced to straddle the conductor (40) and penetrate the insulation (44) and engage and grip the conductor (42), thereby establishing an electrical connection with the conductor (42). The flaps (16) may be used as levers against which forces are applied to pivot the plate portion (10) against the conductor (40). As shown in FIGS. 5 and 6, the portions (16A) (16B) of the flaps (16) overlie and press against the conductor, and press the conductor against a lip which is provided by that portion of the extended sidewall (20) having the tab (18) therein, thereby providing a strain relief which grips the conductor (40).

Figure 9:
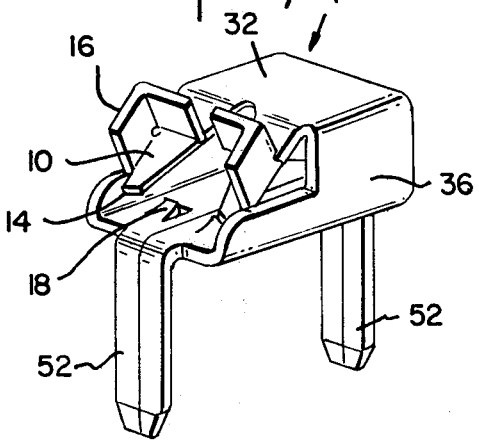
Figure 10:
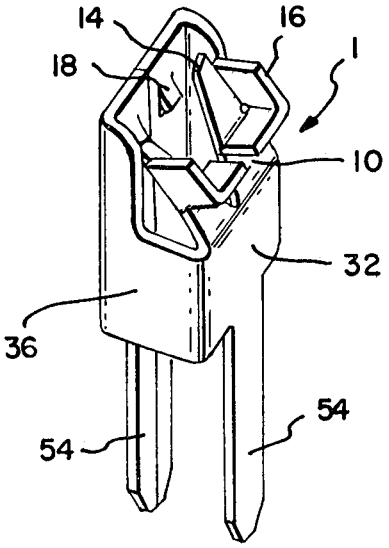

Although a preferred embodiment is shown and disclosed in detail, other embodiments and modifications thereof are intended to be covered by the spirit and scope of the invention. For example the blank (6) is readily modified to form a pin portion, as shown at (48) in FIG. 7, in place of the receptacle portion (2). For example, FIG. 8 shows a ring portion (50) which may replace the receptacle portion (2). For example, FIGS. 9 and 10 show male electrical terminals (52) (54) in place of the receptacle portion (2).

I claim:

1. A stamped and formed electrical contact for connection to an electrical conductor comprises a plate portion, a notch communicating with a free end of the plate portion, opposite sides of the notch define insulation penetrating and conductor engaging jaws constructed for straddling and penetrating a conductor to establish an electrical connection, characterized in that; a conductor receiving receptacle is connected adjacent to the plate portion, the receptacle has sidewalls and an open end so as to provide an internal cavity for receipt of the conductor within the receptacle, the plate portion is pivotal toward the cavity of the receptacle, and into electrical connection with the conductor, and tabs on the receptacle lock the plate portion transversely of the cavity of the receptacle with the jaws penetrating the conductor, said plate portion further having flaps projecting therefrom for pressing against the conductor when the plate portion projects transversely of the cavity and the jaws penetrate the conductor.

2. The contact as recited in claim 1, further characterized in that; one of the sidewalls of the receptacle provides a lip supporting the conductor, and the flaps press the conductor against the lip.

3. The contact as recited in claim 1, further characterized in that; the flaps are integral with respective jaws and are bent out of the plane of the plate portion, portions of the flaps project toward each other and press against a conductor when the plate portion projects transversely of the cavity and the jaws penetrate the conductor.

4. A stamped and formed electrical contact for connection to an electrical conductor comprises a plate portion, a notch communicating with a free end of the plate portion, opposite sides of the notch define insulation penetrating and conductor engaging jaws constructed for straddling and penetrating a conductor to establish an electrical connection, characterized in that; a conductor receiving receptacle is adjacent the plate portion, the receptacle having an open end and an internal cavity for receipt of the conductor within the receptacle, the plate portion is pivotally connected to the remainder of the terminal and is pivotal towards the cavity of the receptacle, and into electrical connection with the conductor, and tabs on the receptacle lock the plate portion transversely of the cavity of the receptacle with the jaws penetrating the conductor, and having flaps projecting out of the plate portion and pressing against the conductor when the plate portion projects transversely of the cavity and jaws penetrate the conductor.

5. The contact as recited in claim 4, further characterized in that: one of the sidewalls of the receptacle provides a lip supporting the conductor, and the flaps press the conductor against the lip.

6. The contact as recited in claim 4, further characterized in that; the flaps are integral with respect of jaws and are bent out of the plane of the plate portion, portions of the flaps project toward each other and press against a conductor when the plate portion projects transversely of the cavity and the jaws penetrate the conductor.

* * * * *